US005184370A

United States Patent [19]

Jung

[11] Patent Number: 5,184,370

[45] Date of Patent: Feb. 9, 1993

[54] DETERGENT INJECTION TYPE VACUUM CLEANER

[75] Inventor: Taik K. Jung, Suweon, Rep. of Korea

[73] Assignee: Samsung Electronics Co., Ltd., Suweon, Rep. of Korea

[21] Appl. No.: 697,407

[22] Filed: May 9, 1991

[30] Foreign Application Priority Data

May 16, 1990 [KR] Rep. of Korea ..... 90-6551[U]

[51] Int. Cl.[5] ..... A47L 7/00

[52] U.S. Cl. ..... 15/321; 15/387

[58] Field of Search ..... 15/321, 387

[56] References Cited

U.S. PATENT DOCUMENTS 4,188,354 1/1980 Brazier ..... 15/321

4,268,935 5/1981 Bessinger ..... 15/387 X

FOREIGN PATENT DOCUMENTS 131358 10/1979 Japan ..... 15/387

61-68912 9/1986 Japan .

*Primary Examiner*—Chris K. Moore

*Attorney, Agent, or Firm*—Burns, Doane, Swecker & Mathis

[57] ABSTRACT

A vacuum cleaner of a detergent injection type uses a part of the suction force of a vacuum impeller actuated by a main motor to pump detergent to a remote cleaning implement. To this end, the vacuum cleaner includes a rotation device disposed in a passage of discharge air and rotated by discharge air and a pump device rotating simultaneously with the rotation device to pump up detergent to the detergent supplying device. Whereby, it has no need of additional motors and is made compact and economical in the construction.

4 Claims, 2 Drawing Sheets

DETERGENT INJECTION TYPE VACUUM CLEANER

BACKGROUND OF THE INVENTION

1. Field of the Invention

The invention relates to a vacuum cleaner of a detergent injection type with a device for supplying detergent to a cleaning brush and an impeller for discharging air sucked up through the cleaning brush.

2. Description of the Related Art

A conventional vacuum cleaner is shown in FIG. 2 as an example, in which a detergent 33 stored in a detergent container 32 is injected to a brush 31 only by sufficient negative pressure in the brush 31. Thus, it takes a while for the rising of the negative pressure and the starting of a cleaning operation. There have also been problems that when the area to be cleaned is positioned above the elevation of the detergent container the detergent sucking function of the negative pressure is insufficient to draw-out the detergent.

In connection with a positive detergent injection, Japanese Laid-Open Publication 61 68912 (04. 09. 1986) discloses a vacuum cleaner including a motor-movable main body with at least a motor-rotatable brush, containers for storing new and used cleaning agents, a means for supplying new cleaning agent to a floor to be cleaned, and a vacuum picking-up device for withdrawing used cleaning agents from the floor. The cleaning agent supplying means has a supplying pump, which is automatically so controlled by the driving motor in the main body, that the supply rate of the cleaning agents can be kept at a uniform level fixed by the user. This vacuum cleaner has, however, the handicap that it requires a separate pump and includes a plurality of motor-rotatable brushes, so that its construction is intricate.

SUMMARY OF THE INVENTION

An object of the invention is to provide a vacuum cleaner in which a part of the suction force generated by a vacuum pump motor is converted into rotational motion to be used for injecting detergent, so that it has a simple and economical construction without an additional motor for injecting detergent.

According to the invention, there is provided a vacuum cleaner with a device for supplying detergent to a cleaning brush and an impeller for discharging air sucked up through cleaning brushes, comprising:

- a rotation means disposed in a passage of air discharged by the impeller and rotated by discharge air;
- a pump means rotating simultaneously with the rotation means pumping the detergent up to the detergent supplying means;
- a transmission means connecting the rotation means to the pump means, for transmitting the rotation force of the rotation means to the pump means; and
- a detergent supply adjusting means disposed in the way of the detergent supplying means to control the detergent flow.

In a preferable embodiment of the invention, the pump means includes a detergent suction element opened at both ends, an outlet for sucked detergents, and a pump impeller disposed between the detergent suction element and the detergent outlet, mounted on the transmission means to generate suction force.

BRIEF DESCRIPTION OF THE DRAWING

The invention will now be further described with reference to the accompanying drawing, in which.

DESCRIPTION OF THE PREFERRED EMBODIMENTS

Figure 1:
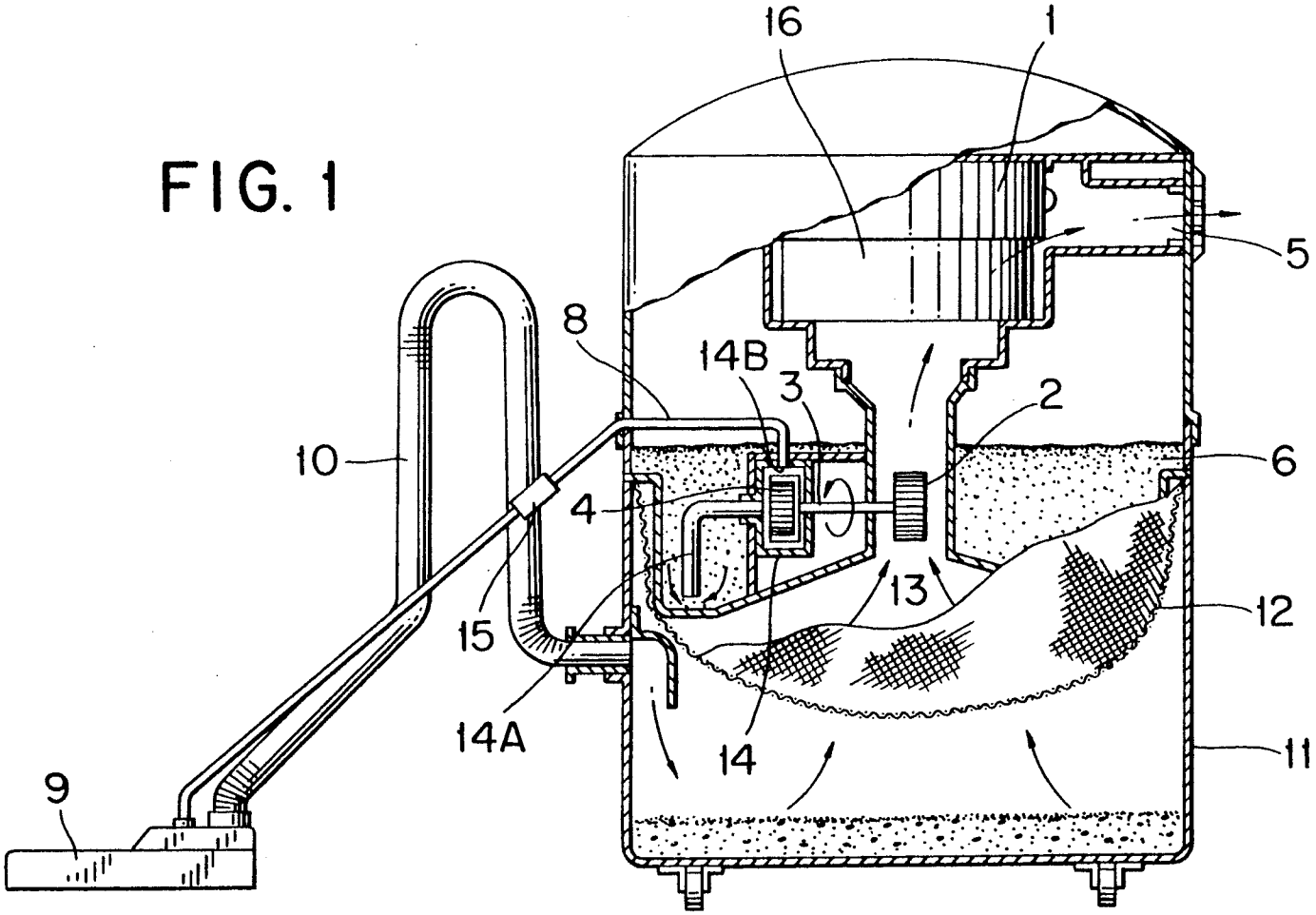
FIG. 1 is a side view, partly broken away, showing a vacuum cleaner of an injection type according to an embodiment of the invention.
Figure 2:
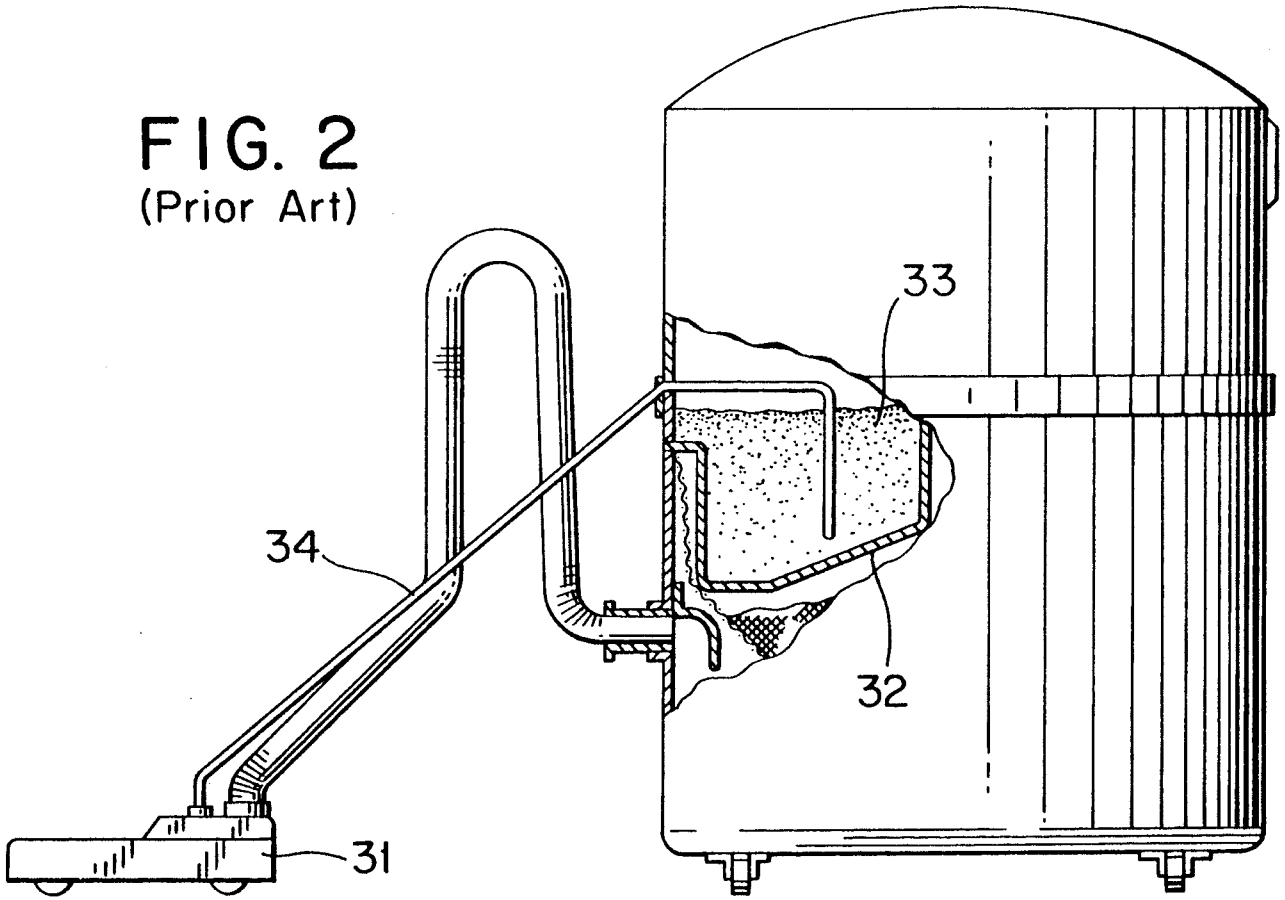
FIG. 2 (Prior Art)
FIG. 2 is a side view, partly broken away, showing a conventional vacuum cleaner of an injection type.

A vacuum cleaner according to this invention, as shown in FIG. 1, includes a body or housing 11, a detergent supplying device 8, a remote implement such as a brush 9 and a rubbish suction device 10. The body 11 has a generally cylindrical shape with movable wheels provided thereunder and contains a filter means 12 filtering the sucked rubbish, a detergent storing container 6 disposed above the filter device 12, and an impeller 16 actuated by a motor 1 disposed above the detergent container 6 and under a cover of the body 11 to suck the air passed through the filter device 12. The body 11 is also provided in the upside of its outer wall with an opening 5 for discharging the air sucked up by the impeller 16.

Under the middle of the impeller 16, there is provided an air passage 13 formed by a cylindrical wall extending through the middle of the detergent container 6. The longitudinal axis of the air passage 13 is arranged in line with the center of the impeller 16.

In the air passage 13, a wind wheel 2 is disposed to be rotated by the air flow passing upwards through the air passage 13 by the suction force of the downstream impeller 16. The wind wheel 2 transmits rotation to a pump device 14, disposed at a lower portion of the detergent container 6, by a transmission device 3 which connects therebetween through the side wall of the detergent container 6 and is formed as a shaft in this illustrated embodiment.

The pump device 14 includes a chamber having a detergent suction pipe element 14A, an outlet 14B for the sucked detergents, and an impeller 4 disposed between the detergent suction element 14A and the detergent outlet 14B. The detergent suction element 14A is opened at both of its ends, one end of which is extended near to the utmost bottom of the detergent container 6 to suck the lowest positioned detergent up, and the other end of which is led to the inside of the pump device 14. The detergent outlet 14B also serves as an inlet of the detergent supplying device 8 to pass the detergent from the pump device 14 to the detergent supplying device 8. The impeller 4 which is fixedly mounted on the shaft 3 transmitting the rotation of the wind wheel 2 is rotated simultaneously with the wind wheel 2 and generates suction force.

The detergent supplying device 8 connects the pump device 14 to the brush 9 so as to transfer the detergent from the pump device 14 to the brush 9 and includes a detergent supply adjusting device 15 on the way to provide the easy control of the detergent flow to users.

The vacuum cleaner according to the invention, being constructed as described above, functions as follows;

When the motor 1 is turned on the impeller 16 rotates to generate negative pressure in a brush 9 which sucks-in dirt and air a floor and air from an outer peripheral. The rubbish and air are led to the inside of the cylindrical body 11 of the vacuum cleaner and filtered by the filter device 12. The filtered air flows upwards through an air passage 13 and rotates the wind wheel 2.

The wind wheel 2 may be here disposed slightly deviated from the longitudinal axis of the air passage 13 toward the wall to improve the rotation efficiency of the wind wheel 2.

The rotation of the wind wheel 2 is transmitted through a transmission device or a shaft 3 to the impeller 4 in the pump means 14 to rotate the impeller 4, whereby the suction force is generated by the pump device 14 and sucks up detergent in the detergent container 6 through detergent suction element 14A. The sucked detergent in the pump device 14 is discharged through the outlet 14B to the detergent supplying device 8 by the centrifugal force of the impeller 4.

The rotation speed of the impeller 4 in the pump device 14, or the detergent supply flow through the detergent supplying device 8, depends on the flow rate of the discharging air through the air passage 13. That is, the rotation speed of the impeller 16 is actuated by a motor 1, so that when it needs the controlling of the detergent supply rate the detergent supply adjusting device 15 can be appropriately manipulated to limit the proper detergent supply.

The user can add water or solvents into the detergent container 6 for the purpose of the usage of the detergent solution of the specific cleaning.

As described above, a vacuum cleaner of a detergent injection type according to the invention can use a part of the suction force of a vacuum impeller actuated by a main motor to pump detergent to a predetermined area to be cleaned so that there is no need of additional motors, and so it can be made compact in its construction; especially of the wind wheel type pump means, and be obviously economical not only in manufacture, but also have reduced power consumption in contrast with known vacuum cleaners.

What is claimed is:

1. A vacuum cleaner comprising housing means containing liquid for delivery to an implement connected to said housing, suction means for drawing air into the implement and through said housing, a pump disposed in said housing and arranged to be driven by said air, said pump arranged to circulate the liquid from said housing to said implement, said pump including a rotary member arranged within a path of the air to be driven thereby, a rotary pump impeller arranged in communication with said liquid and said implement, said rotary member and said pump impeller being interconnected so that the former rotates the latter.

2. A vacuum cleaner according to claim 1, wherein said impeller is disposed in a chamber of said housing which has an inlet communicating with said liquid and an outlet communicating with said implement, such that rotation of said pump impeller causes liquid to be sucked-in through said inlet and forced-out through said outlet.

3. A vacuum cleaner according to claim 1 including an air passage formed in said housing for the passage of the air, said rotary member being disposed in said air passage, said suction means comprising a motor-driven impeller communicating with said air passage downstream of said rotary member.

4. A vacuum cleaner according to claim 3, wherein said air passage extends through a liquid storage compartment in said housing.

* * * * *